US006688852B2

(12) United States Patent
Uneyama et al.

(10) Patent No.: US 6,688,852 B2
(45) Date of Patent: Feb. 10, 2004

(54) MEANS FOR RESTRICTING DRIVE SHAFT MOVEMENT FOR A PISTON TYPE COMPRESSOR

(75) Inventors: Hiroshi Uneyama, Kariya (JP); Tetsuhiko Fukanuma, Kariya (JP); Hiroshi Kubo, Kariya (JP); Hiroaki Kayukawa, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 32 days.

(21) Appl. No.: 09/992,889

(22) Filed: Nov. 6, 2001

(65) Prior Publication Data

US 2002/0085924 A1 Jul. 4, 2002

(30) Foreign Application Priority Data

Nov. 7, 2000 (JP) ..... 2000-339105

(51) Int. Cl.[7] ..... F04B 1/26
(52) U.S. Cl. ..... 417/222.2; 92/12.2
(58) Field of Search ..... 417/222.2; 92/12.2

(56) References Cited

U.S. PATENT DOCUMENTS

| | | | | |
|---|---|---|---|---|
| 5,207,078 A | * | 5/1993 | Kimura et al. | 417/222.2 |
| 5,752,809 A | | 5/1998 | Makino et al. | 417/269 |
| 6,179,578 B1 | * | 1/2001 | Kayukawa et al. | 417/269 |
| 6,203,284 B1 | | 3/2001 | Kawaguchi et al. | 417/222.2 |
| 6,244,159 B1 | | 6/2001 | Kimura et al. | 92/12.2 |
| 2001/0021348 A1 | * | 9/2001 | Ota et al. | |
| 2002/0018722 A1 | * | 2/2002 | Kubo et al. | |
| 2002/0031433 A1 | * | 3/2002 | Sawa et al. | |
| 2002/0172602 A1 | * | 11/2002 | Fukanuma et al. | |

FOREIGN PATENT DOCUMENTS

| | | | |
|---|---|---|---|
| DE | 197 09 935 A1 | 11/1997 | |
| EP | 0 340 024 | 11/1989 | |
| EP | 0 965 804 A2 | 12/1999 | |
| EP | 1 122 428 A2 | 8/2001 | |
| FR | 2 738 301 | 3/1997 | |
| JP | 2-23827 | 6/1990 | 92/12.2 |
| JP | 2000-002180 | 1/2000 | 92/12.2 |

* cited by examiner

*Primary Examiner*—Cheryl J. Tyler
(74) *Attorney, Agent, or Firm*—Morgan & Finnegan, LLP

(57) ABSTRACT

A piston type compressor includes a housing, which defines a crank chamber. A valve plate forms a part of the housing. A drive shaft is located in the crank chamber. A contact member is plastically deformed and press fitted to the drive shaft. An inner wall and a first sub-plate are located in the housing and limit the axial movement of the drive shaft, respectively. After the contact member is attached to the drive shaft, the axial load required to change the position of the contact member is greater than the maximum axial load applied to the drive shaft due to the increase of the pressure in the crank chamber, and less than the load applied to the contact member by the first sub-plate in accordance with the difference in the thermal expansion coefficient of the housing and the drive shaft.

16 Claims, 2 Drawing Sheets

MEANS FOR RESTRICTING DRIVE SHAFT MOVEMENT FOR A PISTON TYPE COMPRESSOR

BACKGROUND OF THE INVENTION

The present invention relates to a piston type compressor for a vehicle air-conditioning system and to a method for manufacturing the piston type compressor.

Japanese Unexamined Patent Publication No. 2000-2180 discloses a swash plate type variable displacement compressor. The compressor includes a drive shaft to which the drive force is transmitted from an engine. A drive plate (swash plate) is coupled to the drive shaft such that the drive plate integrally rotates about and inclines with respect to the drive shaft. The drive plate is located in a crank chamber. Pistons are coupled to the drive plate and are accommodated in cylinder bores. The rotation of the engine is converted into the reciprocation of the pistons through the drive shaft and the drive plate. The inclination angle of the drive plate changes in accordance with the change in the difference between the pressure in the crank chamber and the pressure in the cylinder bores. The stroke of the pistons is changed in accordance with the inclination angle of the drive plate. The displacement of the compressor is changed accordingly.

A coil spring limits the axial movement of the drive shaft in a housing. The coil spring constantly presses the drive shaft in the axial direction. Limiting the movement of the drive shaft prevents the collision between the head of each piston and a valve plate when the drive shaft slides.

However, to reliably prevent the drive shaft from moving axially, the coil spring must apply a great force. This reduces the life of a thrust bearing that receives force from the coil spring and reduces the power loss of the compressor increases. The increase of the power loss of the compressor deteriorates the fuel economy of the vehicle (engine).

Therefore, a swash plate type variable displacement compressor disclosed in, for example, Japanese Examined Utility Model Publication 2-23827 is provided with a stopper (adjustment screw) that abuts against the end of a drive shaft instead of the coil spring. The stopper is threaded to a bore, in which the end of the drive shaft is accommodated, for limiting the movement of the drive shaft.

The housing and the drive shaft expand and contract by heat. The amount of deformation with respect to the same temperature changes differs between the housing and the drive shaft. This is due to the difference in the thermal expansion coefficient, which is intrinsic to each of the housing and the drive shaft. For example, when the amount of thermal contraction of the housing is greater than that of the drive shaft with respect to the same temperature changes, the space between the stopper of the housing and the drive shaft in the axial direction decreases according to the decrease of the ambient temperature. If the housing and the drive shaft continue to contract even after the space is zero, the drive shaft is pressed by the housing and the housing receives a great axial load.

SUMMARY OF THE INVENTION

The objective of the present invention is to provide a piston type compressor that prevents a drive shaft from receiving a load generated by the difference between the thermal expansion coefficient of the housing and that of a drive shaft and reduces the manufacturing cost, and to provide a method for manufacturing the piston type compressor.

To achieve the foregoing and other objectives and in accordance with the purpose of the present invention, a piston type compressor is provided. The piston type compressor includes a housing, a drive shaft, a cylinder block, a valve plate, a plurality of single-headed pistons, a drive plate, a control mechanism, a contact member, a first stopper, and a second stopper. The housing defines a crank chamber. The drive shaft extends through the crank chamber and is rotatably supported by the housing. The cylinder block forms a part of the housing and defines a plurality of cylinder bores therein. The valve plate has a suction port, a suction valve, a discharge port, and a discharge valve corresponding to each cylinder bore. The valve plate is secured to the housing to close the cylinder bores. Each single-headed piston is reciprocally accommodated in one of the cylinder bores. The drive plate is located in the crank chamber and operably connected to the pistons for converting the rotation of the drive shaft to the reciprocation of the pistons. The control mechanism controls the inclination angle of the drive plate by controlling the pressure in the crank chamber to change the stroke of the pistons. The contact member is plastically deformed and press fitted to the drive shaft. The first stopper is located in the housing and limits the axial movement of the drive shaft. The first stopper limits the movement of the drive shaft in the direction away from the valve plate. The second stopper is provided in the valve plate. The second stopper limits the movement of the drive shaft toward the valve plate by the abutment with the contact member. After the contact member is attached to the drive shaft, the axial load required to change the position of the contact member is greater than the maximum axial load applied to the drive shaft due to the increase of the pressure in the crank chamber, and less than the load applied to the contact member by the second stopper in accordance with the difference in the thermal expansion coefficient of the housing and the drive shaft.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 3(*b*) is an enlarged partial view of the contact member of FIG. 3(*a*) when a valve plate is attached.

DETAILED DESCRIPTION OF THE PREFERRED EMBODIMENTS

A piston type variable displacement compressor for a vehicle air-conditioning system according to one embodiment of the present invention will be described with reference to FIGS. 1 to 3(*b*).

Figure 1:
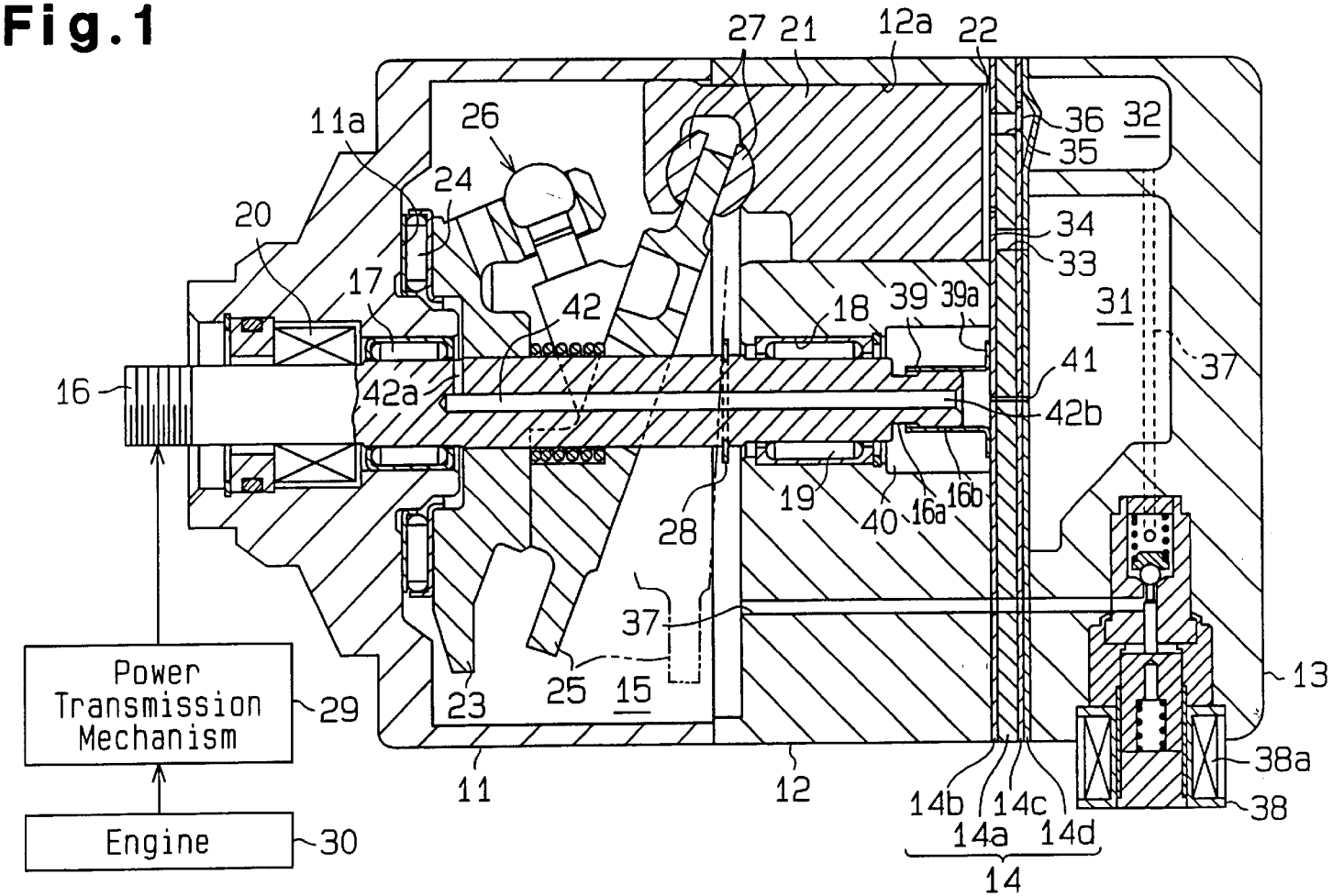
FIG. 1 is a cross-sectional view illustrating a compressor according to one embodiment of the present invention.

As shown in FIG. 1, a front housing 11 is fixed to the front end of a cylinder block 12. A rear housing 13 is fixed to the rear end of the cylinder block 12. A valve plate 14 is located between the rear housing 13 and the cylinder block 12. The front housing 11, the cylinder block 12, and the rear housing 13 are secured by bolts (not shown). In this embodiment, the front housing 11, the cylinder block 12, the rear housing 13, and the valve plate 14 form a housing of the compressor. Each member (11, 12, 13, and 14) of the housing is made of aluminum alloy for reducing weight. The left side of FIG. 1 is referred to as the front end of the compressor and the right side of FIG. 1 is referred to as the rear end of the compressor.

The valve plate 14 includes a main plate 14*a*, a first sub-plate 14*b*, a second sub-plate 14*c*, and a retainer plate 14*d*. The first sub-plate 14*b*, which is made of hardened carbon steel, is fixed to the front surface of the main plate 14*a*. The second sub-plate 14*c* is fixed to the rear surface of the main plate 14*a*. The retainer plate 14*d* is fixed to the rear surface of the second sub-plate 14*c*. The first sub-plate 14*b* of the valve plate 14 is fixed to the cylinder block 12.

A crank chamber 15 is defined between the front housing 11 and the cylinder block 12. A drive shaft 16, which is made of iron-based metal, extends through the crank chamber 15. The front end of the drive shaft 16 projects from the housing. The drive shaft 16 is rotatably supported between the front housing 11 and the cylinder block 12. The front end of the drive shaft 16 is supported by the front housing 11 through a first radial bearing 17. A bearing bore 18 is provided at the substantial center of the cylinder block 12. The rear end of the drive shaft 16 is supported by a second radial bearing 19 arranged in the bearing bore 18. A shaft sealing assembly 20 is arranged about the front end portion of the drive shaft 16.

Cylinder bores 12*a* (only one bore is shown in FIG. 1) are arranged in the cylinder block 12 at equal angular intervals about the axis of the drive shaft 16. A single-headed piston 21 is accommodated in each cylinder bore 12*a*. The opening of each cylinder bore 12*a* is closed by the valve plate 14 and each piston 21. A compression chamber 22 is defined in each cylinder bore 12*a*. The volume of each compression chamber 22 changes in accordance with the reciprocation of the corresponding piston 21.

A rotor, which is a lug plate 23 in this embodiment, is fixed to the drive shaft 16 in the crank chamber 15. The lug plate 23 integrally rotates with the drive shaft 16. A thrust bearing 24 is provided between the lug plate 23 and an inner wall 11*a* of the front housing 11. The inner wall 11*a* receives the axial load generated by the reaction force that acts on each piston 21 during the compression. The inner wall 11*a* functions as a first stopper that limits the forward movement of the drive shaft 16.

A drive plate, which is a swash plate 25 in this embodiment, is provided in the crank chamber 15. The drive shaft 16 is inserted through a shaft hole formed on the swash plate 25. A hinge mechanism 26 is arranged between the lug plate 23 and the swash plate 25. The swash plate 25 is coupled to the lug plate 23 through the hinge mechanism 26 and is supported by the drive shaft 16. Thus, the swash plate 25 integrally rotates with the lug plate 23 and the drive shaft 16. The swash plate 25 inclines with respect to the drive shaft 16 while axially sliding along the drive shaft 16. The lug plate 23 and the hinge mechanism 26 form inclination control means.

Each piston 21 is coupled to the periphery of the swash plate 25 by a pair of shoes 27. The rotation of the drive shaft 16 is transmitted to the swash plate 25 and the rotation of the swash plate 25 is converted to the reciprocation of each piston 21 through the corresponding pair of shoes 27.

A limit ring 28 is provided on the surface of the drive shaft 16 between the swash plate 25 and the cylinder block 12. As illustrated by the line having one long and two short dashes in FIG. 1, the minimum inclination angle of the swash plate 25 is determined when the swash plate 25 contacts the limit ring 28. As illustrated by the continuous line in FIG. 1, the maximum inclination angle of the swash plate 25 is determined when the swash plate 25 abuts against the lug plate 23.

The drive shaft 16 is operably connected to an engine 30, which functions as a drive source, through a power transmission mechanism 29. The power transmission mechanism 29 may be a clutch mechanism such as an electromagnetic clutch or a clutchless mechanism such as a combination of a belt and a pulley. The clutch mechanism selectively connects and disconnects the power by an external electrical control. The clutchless mechanism does not have a clutch mechanism and constantly transmits power. A clutchless type power transmission mechanism 29 is used in this embodiment.

A suction chamber 31 is defined at the center of the rear housing 13. A discharge chamber 32 is defined radially outward of the suction chamber 31.

A suction port 33, a suction valve 34, a discharge port 35, and a discharge valve 36 are formed on the valve plate 14 for each cylinder bore 12*a*. Each suction valve 34 selectively opens and closes the corresponding suction port 33. Each discharge valve 36 selectively opens and closes the corresponding discharge port 35. The suction chamber 31 and each cylinder bore 12*a* are connected by the corresponding suction port 33. The discharge chamber 32 and each cylinder bore 12*a* are connected by the corresponding discharge port 35. The suction chamber 31 and the discharge chamber 32 are connected by an external refrigeration circuit, which is not shown in the figures.

A supply passage 37 is provided in the cylinder block 12 and the rear housing 13. The supply passage 37 connects the crank chamber 15 and the discharge chamber 32. A control valve 38, which is an electromagnetic valve, is provided in the supply passage 37. When a solenoid 38*a* is excited, the supply passage 37 is closed. When the solenoid 38*a* is demagnetized, the supply passage 37 is opened. The opening degree of the supply passage 37 is adjusted in accordance with the level of the exciting current applied to the solenoid 38*a*. The control valve 38 acts as a control mechanism for controlling the inclination angle of the drive plate by controlling the pressure in the crank chamber to change the stroke of the pistons A contact member chamber 40 is defined between the bearing bore 18 and the first sub-plate 14*b*. A contact member 39 for preventing the drive shaft 16 from moving toward the valve plate 14 is accommodated in the contact member chamber 40. The opening of the contact member chamber 40 is closed by the valve plate 14. The contact member chamber 40 and the suction chamber 31 are connected by a passage 41 formed in the valve plate 14. The passage 41 is formed opposite to the substantial center of the drive shaft 16.

The drive shaft 16 has an axial passage 42 that connects the contact member chamber 40 and the crank chamber 15. The axial passage 42 has an inlet 42*a* and an outlet 42*b*. The inlet 42*a* is located between the first radial bearing 17 and the lug plate 23. The outlet 42*b* is formed on the rear end surface of the drive shaft 16. The axial passage 42, the bearing bore 18, the contact member chamber 40, and the passage 41 form a bleed passage that connects the crank chamber 15 and the suction chamber 31. The passage 41 functions as a restrictor.

Figure 2:
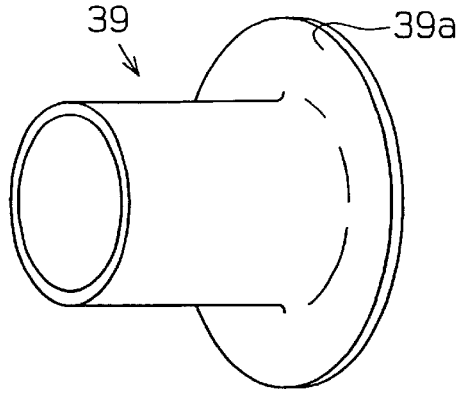
FIG. 2 is a perspective view illustrating a contact member provided for the compressor of FIG. 1.

As shown in FIG. 2, the cylindrical contact member 39 has a flange 39*a*. The contact member 39 is, for example, formed by pressing SPC (cold rolled steel) or SUS304 (stainless steel). The contact member 39 is press fitted to the rear end of the drive shaft 16. The movement of the drive shaft 16 toward the valve plate 14 is limited by the abutment of the flange 39*a* of the contact member 39 against the first sub-plate 14*b* of the valve plate 14. The front surface of the first sub-plate 14*b* functions as a second stopper that limits the movement of the drive shaft 16 toward the valve plate 14.

Figure 3A:
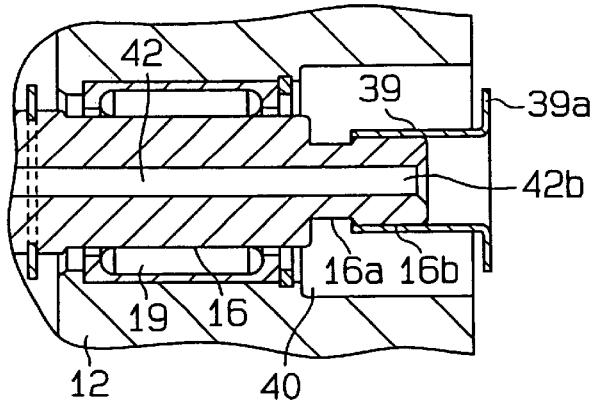
FIG. 3(*a*) is an enlarged partial view of the contact member inserted in the rear end of a drive shaft.
Figure 3B:
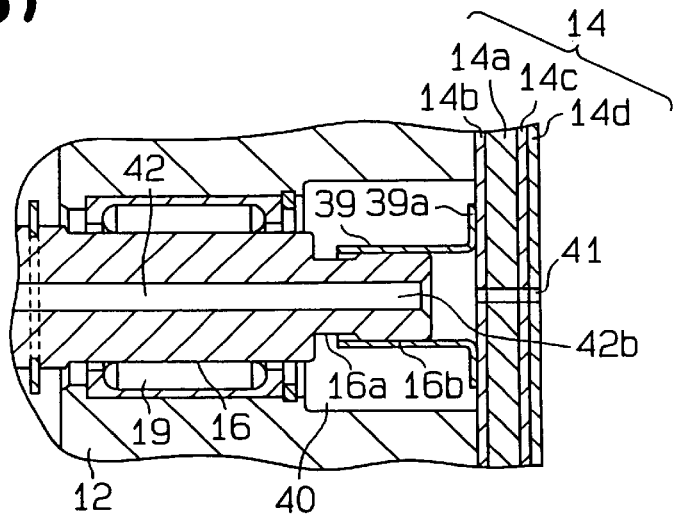

As shown in FIGS. 1, 3(*a*), and 3(*b*), the rear end of the drive shaft 16 has a first small diameter portion 16*a* and a second small diameter portion 16*b*. The second small diameter portion 16*b* is located between the first small diameter portion 16*a* and the first sub-plate 14*b*. The outer diameter of the second small diameter portion 16*b* is greater than the first small diameter portion 16*a* and smaller than the inner diameter of the second radial bearing 19.

The contact member 39 is fitted to the second small diameter portion 16*b* such that the contact member 39 does not contact the first small diameter portion 16*a*. As shown in FIG. 3(*b*), when the contact member 39 is attached to the drive shaft 16 and accommodated in the contact member chamber 40, which is closed by the valve plate 14, the contact member 39 completely covers the second small diameter portion 16*b*. The contact member 39 is press fitted to the second small diameter portion 16*b* causing plastic deformation.

The impact load is axially applied to the drive shaft 16 from the piston 21 due to the increase of the pressure in the crank chamber 15 (crank pressure). After the contact member 39 is attached to the drive shaft 16, the axial load required to change the position of the contact member 39 is greater than the maximum impact load. The pressure load is axially applied to the contact member 39 by the second stopper due to the difference in the thermal expansion coefficient of the housing 11 and the drive shaft 16. The axial load required to change the position of the contact member 39 is less than the pressure load.

A method for installing the compressor, and more particularly, the steps for press fitting the contact member 39 to the drive shaft 16 are described below.

FIG. 3(*a*) is an enlarged view of an important part of the compressor before attaching the rear housing 13 and the valve plate 14. In this state, the contact member chamber 40 is open on the side opposite to the side to which the drive shaft 16 is inserted. The contact member 39 is inserted to the second small diameter portion 16*b* of the drive shaft 16 from the opening of the contact member chamber 40. Pressing of the contact member 39 is temporarily stopped leaving a part of the contact member 39 projecting from the contact member chamber 40.

As shown in FIG. 3(*b*), the first sub-plate 14*b* of the valve plate 14 is pressed against the contact member 39. Then, the first sub-plate 14*b* is fixed to the cylinder block 12. The contact member 39 is further press fitted to the second small diameter portion 16*b* and accommodated within the contact member chamber 40.

The operation of the compressor is described below.

The swash plate 25 integrally rotates with the drive shaft 16 through the lug plate 23 and the hinge mechanism 26. The rotation of the swash plate 25 is converted to the reciprocation of the pistons 21 through the shoes 27. Refrigerant supplied to the suction chamber 31 from the external refrigeration circuit is drawn into each compression chamber 22 through the corresponding suction port 33. The refrigerant in each compression chamber 22 is compressed by the stroke of the corresponding piston 21. The compressed refrigerant is then discharged to the discharge chamber 32 through the corresponding discharge port 35. As a result, suction, compression and discharge of refrigerant gas are repeated in the compression chamber 22. The refrigerant discharged to the discharge chamber 32 flows to the external refrigeration circuit through a discharge passage (not shown).

The opening degree of the control valve 38, or the opening degree of the supply passage 37, is adjusted by the controller (not shown) in accordance with the cooling load. This changes the opening degree between the discharge chamber 32 and the crank chamber 15.

When the cooling load is great, the opening degree of the supply passage 37 is decreased. Thus, the flow rate of refrigerant gas supplied to the crank chamber 15 from the discharge chamber 32 decreases. When the flow rate of refrigerant gas supplied to the crank chamber 15 decreases, refrigerant gas is supplied to the suction chamber 31 through the axial passage 42. This gradually decreases the pressure in the crank chamber 15. As a result, the difference between the pressure in the crank chamber 15 and the pressure in the cylinder bores 12*a* decreases. Then, the swash plate 25 is displaced to the maximum inclination position. Therefore, the stroke of the each piston 21 increases, which increases the displacement of the compressor.

When the cooling load decreases, the opening degree of the control valve 38 increases. Then, the flow rate of refrigerant gas supplied to the crank chamber 15 from the discharge chamber 32 increases. When the flow rate of refrigerant gas supplied to the crank chamber 15 is greater than the flow rate of refrigerant gas supplied to the suction chamber 31 through the axial passage 42, the pressure in the crank chamber 15 gradually increases. As a result, the difference between the pressure in the crank chamber 15 and the pressure in the cylinder bores 12*a* increases. Then, the swash plate 25 is displaced to the minimum inclination position. Therefore, the stroke of each piston 21 decreases, which decreases the displacement of the compressor.

The inner wall 11*a* of the front housing 11 receives the compression load of refrigerant gas applied to the pistons 21 through the shoes 27, the swash plate 25, the hinge mechanism 26, the lug plate 23, and the thrust bearing 24. In other words, when the compressor is operating, the drive shaft 16, the swash plate 25, the lug plate 23, and the pistons 21 axially moves away from the valve plate 14 in accordance with the compression load. This movement is limited by the inner wall 11*a* of the front housing 11 through the thrust bearing 24. The compressor generates heat while operating and the temperature increases from when the compressor was installed. The temperature increase causes the housing and the drive shaft 16 to expand. The difference in the amount of deformation between the housing and the drive shaft 16 produces a space between the valve plate 14 and the contact member 39. The distance of the space between the valve plate 14 and the contact member 39 is less than the distance of the space between the head of the piston 21 and the valve plate 14.

If a displacement limiting control is performed when the compressor is operating with the maximum displacement, the control valve 38 abruptly closes the supply passage 37 from the full open state. Thus, high pressure refrigerant gas in the discharge chamber 32 is supplied to the crank chamber 15 abruptly. However, the bleed passage, which includes the axial passage 42, does not release sufficient amount of refrigerant gas that was drawn into the crank chamber 15. Therefore, the pressure in the crank chamber 15 abruptly increases. When the pressure in the crank chamber 15 abruptly increases, the inclination angle of the swash plate 25 decreases abruptly. As a result, the swash plate 25 having the minimum inclination angle (illustrated by the line having one long and two short dashes in FIG. 1) is pressed against the limit ring 28 with excessive force, or pulls the lug plate 23 rearward with great force through the hinge mechanism 26.

Therefore, the drive shaft 16 receives great force (impact load) in the axial direction toward the valve plate 14 and moves. In this case, the movement of the drive shaft 16 is limited by the abutment of the contact member 39 against the valve plate 14. Thus, each piston 21 is prevented from colliding with the valve plate 14 when each piston 21 reaches the top dead center. The amount of axial load required to change the position of the contact member 39 with respect to the drive shaft 16 is greater than the impact load. Thus, the position of the contact member 39 with respect to the drive shaft 16 does not change by the abutment of the contact member 39 against the valve plate 14. The displacement limiting control limits the displacement of the compressor to be minimum for a predetermined time period. The displacement limit control is performed such that the output of the engine contributes for the forward drive force when a vehicle accelerates for overtaking or climbing hill.

When the ambient temperature decreases, each part of the compressor cools down and contracts. Parts that have great thermal expansion coefficient contract with greater deformation rate (amount of deformation per unit length) than the parts that have small thermal expansion coefficient. Each part (11, 12, and 13) of the housing is made of aluminum. The drive shaft 16 is made of iron-based metal. Aluminum alloy has greater thermal expansion coefficient than iron. Therefore, the housing contracts more than the drive shaft 16 does. As a result, the drive shaft 16 is axially pressed by the housing. In this case, the contact member 39 receives forward pressure load from the valve plate 14. The axial load required to change the position of the contact member 39 with respect to the drive shaft 16 is less than the pressure load. Thus, when the contact member 39 receives the pressure load, the contact member 39 is displaced forward with respect to the drive shaft 16. As a result, the drive shaft 16 does not receive excessive pressure load caused by the contraction of the housing.

The preferred embodiment provides following advantages.

The axially rearward movement of the drive shaft 16 is limited by the abutment of the contact member 39 against the valve plate 14. This solves the problems caused when a spring is provided. The problems are the decrease of the life of the thrust bearing 24 that receives the spring load and the increase of power loss of the compressor at the thrust bearing 24. Decrease of the power loss of the compressor improves the fuel economy of a vehicle (engine 30). Also, the structure is simplified by eliminating the spring.

The amount of axial load required to change the position of the contact member 39 with respect to the drive shaft 16 is set greater than the maximum impact load axially applied to the drive shaft 16 by the piston 21 due to the increase of the crank pressure. Therefore, the position of the contact member 39 does not change by the increase of the crank pressure. As a result, the movement of the drive shaft 16 is reliably limited by the contact member 39 and the valve plate 14.

The axial load required to change the position of the contact member 39 with respect to the drive shaft 16 is less than the axial pressure load caused between the housing and the drive shaft 16 due to the difference in the thermal expansion coefficient. Therefore, when the contact member 39 is pressed by the valve plate 14 due to the difference in the thermal expansion coefficient, the position of the contact member 39 with respect to the drive shaft 16 changes. Thus, the drive shaft 16 does not receive excessive load from the valve plate 14 due to the difference in the thermal expansion coefficient.

When press fitted to the drive shaft 16, the contact member 39 is plastically deformed. Therefore, the contact portions of the contact member 39 and the drive shaft 16 need not be manufactured as accurately as when the contact member 39 is press fitted to the drive shaft 16 causing only elastic deformation. In other words, the tolerance of the contact member 39 and the drive shaft 16 is increased, which reduces the manufacturing cost.

The contact member 39 is press fitted to the drive shaft 16. Therefore, no bolts, hardware, nor adhesive is needed for securing the contact member 39 to the drive shaft 16. Thus, the contact member 39 is simply attached by merely pressing the contact member 39 to the drive shaft 16. The position of the contact member 39 is simply determined by merely pressing the contact member 39 by the valve plate 14 when attaching the valve plate 14 to the cylinder block 12.

The contact member 39 is fitted to the periphery of the rear end of the drive shaft 16. Thus, the contact area between the contact member 39 and the drive shaft 16 is larger than when, for example, press fitting a contact member to a hole formed in the end of the drive shaft 16. Therefore, the pressure between the contact member 39 and the drive shaft 16 is sufficient and the contact member 39 is reliably attached to the drive shaft 16.

When attached to the drive shaft 16 and accommodated in the contact member chamber 40, the contact member 39 always contacts the drive shaft 16 at a part that corresponds to the axial length of the second small diameter portion 16*b*. In other words, the contact member 39 contacts the drive shaft 16 at a constant axial length. Therefore, the axial load required to change the position of the contact member 39 with respect to the drive shaft 16 does not change.

The portion of the contact member 39 that abuts against the first sub-plate 14*b* of the valve plate 14 is formed into a flange shape. Thus, the contact area of the contact member 39 with respect to the first sub-plate 14*b* is large. Therefore, wear of the contact member 39 and the valve plate 14 is reduced.

The first sub-plate 14*b* of the valve plate 14 functions as a second stopper. Therefore, the structure for limiting the rearward movement of the drive shaft 16 is simplified.

The rearward movement of the drive shaft 16 is limited by the abutment of the contact member 39 against the first sub-p late 14*b*. The first sub-plate 14*b* is formed of a material that has greater wear resistance than the main plate 14*a*. Thus, the second stopper has improved wear resistance.

The rearward movement of the drive shaft 16 is limited by using the space that accommodates the rear end of the drive shaft 16 (contact member chamber 40). Since extra parts are not needed for limiting the movement of the drive shaft 16, the size of the compressor is reduced.

The contact member 39 is formed by pressing. Therefore, the cost for manufacturing the contact member 39 is reduced from the cost for manufacturing a contact member by cutting.

The preferred embodiment may be changed as follows.

The flange may be formed to extend radially inward of the contact member 39. In this case, the outer diameter of the contact member is easily made smaller than the inner diameter of the second radial bearing 19. Thus, the second radial bearing 19 may be taken off the drive shaft 16 while the contact member is attached. This facilitates the maintenance of the compressor.

An annular groove may be formed on the periphery of the rear end of the drive shaft 16. Then, the contact member 39 may be fitted to the drive shaft 16 at the portion rearward of the groove. In this case, cutting of the drive shaft 16 to form the second small diameter portion 16*b* may be omitted and the manufacturing cost is reduced.

When the contact member 39 is attached to the drive shaft 16 and accommodated in the contact member chamber 40, the contact member 39 may only cover a part of the second small diameter portion 16*b*.

The drive shaft 16 may have a constant diameter, or the inner diameter of the second radial bearing 19, from the portion to which the second radial bearing 19 is fitted to the rear end. In this case, the contact member 39 is press fitted to the rear end of the drive shaft 16, the outer diameter of which is equal to the inner diameter of the second radial bearing 19. Therefore, cutting of the first small diameter 16*a* and the second small diameter 16*b* may be omitted, which reduces the manufacturing cost.

The contact member 39 may be formed into a cylindrical shape without flange 39*a*. In this case, the process for forming the flange 39*a* may be omitted and the manufacturing cost is reduced.

The contact member 39 may abut against a part other than the first sub-plate 14*b* of the valve plate 14. For example, a member that functions as a second stopper may be provided between the contact member 39 and the first sub-plate 14*b* in the contact member chamber 40. Alternatively, a part of the cylinder block 12 may be formed to project inward of the contact member chamber 40 such that the projection abuts against the contact member 39.

The contact member 39 may abut against the main plate 14*a* to limit the rearward movement of the drive shaft 16.

A recess may be formed on the rear end surface of the drive shaft 16. A contact member may be press fitted into the recess. This facilitates to form the outer diameter of the contact member smaller than the inner diameter of the second radial bearing 19.

Wear resistance coating may be applied to the contact member 39 or the first sub-plate 14*b*. This reduces the wear of the contact member 39 and the first sub-plate 14*b*.

The present invention may be embodied in a wobble-type variable displacement compressor.

The present invention may be embodied in a fixed displacement compressor, in which the swash plate is directly fixed to the drive shaft.

Therefore, the present examples and embodiments are to be considered as illustrative and not restrictive and the invention is not to be limited to the details given herein, but may be modified within the scope and equivalence of the appended claims.

What is claimed is:

1. A piston type compressor comprising;

a housing, which defines a crank chamber;

a drive shaft, which extends through the crank chamber and is rotatably supported by the housing;

a cylinder block, wherein the cylinder block forms a part of the housing and defines a plurality of cylinder bores therein;

a valve plate, wherein the valve plate forms a part of the housing and has a suction port, a suction valve, a discharge port, and a discharge valve corresponding to each cylinder bore, and the valve plate closes one end of each cylinder bore;

a plurality of single-headed pistons, wherein each single-headed piston is reciprocally accommodated in one of the cylinder bores;

a drive plate, which is located in the crank chamber and operably connected to the pistons for converting the rotation of the drive shaft to the reciprocation of the pistons;

a control mechanism for controlling the inclination angle of the drive plate by controlling the pressure in the crank chamber to change the stroke of the pistons;

a contact member, which is plastically deformed and press fitted to the drive shaft;

a first stopper, which is located in the housing and limits the axial movement of the drive shaft, wherein the first stopper limits the movement of the drive shaft in the direction away from the valve plate;

a second stopper, which is provided in the housing, wherein the second stopper limits the movement of the drive shaft toward the valve plate by the abutment with the contact member, wherein, after the contact member is attached to the drive shaft, the axial load required to change the position of the contact member is greater than the maximum axial load applied to the drive shaft due to the increase of the pressure in the crank chamber, and less than the load applied to the contact member by the second stopper in accordance with the difference in the thermal expansion coefficient of the housing and the drive shaft.

2. The compressor according to claim 1, wherein the contact member contacts the drive shaft at a constant axial length.

3. The compressor according to claim 1, wherein a portion of the contact member that contacts the second stopper is formed into a flange shape.

4. The compressor according to claim 3, wherein the contact member includes a cylindrical portion that covers an end portion of the drive shaft.

5. The compressor according to claim 1, wherein a bearing bore is formed through the cylinder block for accommodating the end portion of the drive shaft, and wherein a portion of the valve plate that faces the bearing bore functions as the second stopper.

6. The compressor according to claim 1, wherein at least one of the second stopper and the contact member is wear resistant.

7. The compressor according to claim 1, wherein the contact member is fitted to the periphery of the drive shaft.

8. The compressor according to claim 1, wherein the contact member is formed by pressing.

9. A piston type compressor comprising;

a housing, which defines a crank chamber;

a drive shaft, which is inserted through the crank chamber and rotatably supported by the housing;

a cylinder block, wherein the cylinder block forms a part of the housing and defines a plurality of cylinder bores therein;

a valve plate, wherein the valve plate is fixed to the cylinder block and has a suction port, a suction valve, a discharge port, and a discharge valve corresponding to each cylinder bore;

a plurality of single-headed pistons, wherein each single-headed piston is reciprocally accommodated in one of the cylinder bores;

a drive plate, which is located in the crank chamber and operably connected to the pistons for converting the rotation of the drive shaft to the reciprocation of the pistons;

a control mechanism for controlling the inclination angle of the drive plate by controlling the pressure in the crank chamber to change the stroke of the pistons;

a contact member, which is plastically deformed and press fitted to the drive shaft;

a first stopper, which is located in the housing and limits the axial movement of the drive shaft, wherein the first stopper limits the movement of the drive shaft in the direction to separate from the valve plate;

a second stopper, which is provided in the valve plate, wherein the second stopper limits the movement of the drive shaft toward the valve plate by the abutment with the contact member, wherein after the contact member is attached to the drive shaft, the axial load required to change the position of the contact member is greater than the maximum axial load applied to the drive shaft due to the increase of the pressure in the crank chamber, and less than the load applied to the contact member by the second stopper in accordance with the difference in the thermal expansion coefficient of the housing and the drive shaft.

10. The compressor according to claim 9, wherein the contact member contacts the drive shaft at a constant axial length.

11. The compressor according to claim 9, wherein a portion of the contact member that contacts the second stopper is formed into a flange shape.

12. The compressor according to claim 11, wherein the contact member includes a cylindrical portion that covers an end portion of the drive shaft.

13. The compressor according to claim 9, wherein a bearing bore is formed through the cylinder block for accommodating the end portion of the drive shaft, and wherein a portion of the valve plate that faces the bearing bore functions as the second stopper.

14. The compressor according to claim 9, wherein at least one of the second stopper and the contact member is wear resistant.

15. The compressor according to claim 9, wherein the contact member is fitted to the periphery of the drive shaft.

16. The compressor according to claim 9, wherein the contact member is formed by pressing.

* * * * *